United States Patent [19]

Holland

[11] Patent Number: 4,868,529

[45] Date of Patent: Sep. 19, 1989

[54] CIRCUIT BREAKER ARMATURE LATCH WITH CONTROL LEG

[75] Inventor: Thomas W. Holland, Wilmington, N.C.

[73] Assignee: Siemens Energy & Automation, Inc., Atlanta, Ga.

[21] Appl. No.: 235,850

[22] Filed: Aug. 24, 1988

[51] Int. Cl.[4] ..... H01H 75/10; H01H 77/06

[52] U.S. Cl. ..... 335/42; 335/45; 335/273

[58] Field of Search ..... 335/23, 35, 273, 42, 335/45

[56] References Cited

U.S. PATENT DOCUMENTS

| | | | |
|---|---|---|---|
| 2,732,455 | 1/1956 | Ericson et al. | 200/88 |
| 2,902,560 | 9/1959 | Stanback et al. | 200/88 |
| 3,171,921 | 3/1965 | Woods | 200/116 |
| 3,275,959 | 9/1966 | Locher | 335/35 |
| 3,288,965 | 11/1966 | Klein | 200/116 |
| 3,488,610 | 1/1970 | Powell | 335/23 |
| 3,950,715 | 4/1976 | Bagalini et al. | 335/35 |
| 3,964,005 | 6/1976 | Schantz | 335/273 |
| 4,156,219 | 5/1979 | Coleman | 335/175 |
| 4,479,101 | 10/1984 | Checinski | 335/23 |

FOREIGN PATENT DOCUMENTS 1298695 4/1962 France .

*Primary Examiner*—H. Broome

*Attorney, Agent, or Firm*—James G. Morrow

[57] ABSTRACT

An improved magnetic armature for magnetically activated circuit breakers. The armature being configured to provide a consistent engagement length between the armature and the contact operating mechanism of a circuit breaker. The armature also being configured to reduce the air gap distance between the armature and the magnetic yoke of a circuit breaker.

6 Claims, 2 Drawing Sheets

CIRCUIT BREAKER ARMATURE LATCH WITH CONTROL LEG

BACKGROUND OF INVENTION

This invention relates to a magnetically activated circuit-breaker device, and more particularly, to the magnetic armature for such a device.

U.S. Pat. No. 4,479,101 has for its subject an electrical circuit breaker having an automatically adjusting magnetic armature. FIG. 1 is a side view of the circuit breaker of U.S. Pat. No. 4,479,101 with its side cover removed. In general, this type of circuit breaker operates in two different modes to open the contacts. In both modes an armature 10 having a latch holder 12 is moved downward such that the interference between the latch holder 12 and the end 14 of the cradle 16 ceases and the contacts 18 are caused to separate. FIG. 2 illustrates the armature 10 of U.S. Pat. No. 4,479,101.

The distinction between the contact opening modes involves the manner in which the armature is moved downward. In the first mode, the armature 10 is urged downward by a magnetic force produced by the magnetic yoke 18 when the current flowing through the circuit breaker exceeds a predetermined amount. In the second mode, the armature 10 is urged downward by a bimetallic strip 20 which is in contact with the end hook extension 22 of the armature 10. When the current flowing through the bimetallic strip 20 reaches a predetermined level, the end portion of the bimetallic strip 20 moves downward due to heating and contacts the hook extension 22 causing the armature 10 to move downward.

FIG. 3 illustrates an enlarged view of the interface between the latch holder 12 and the end 14 and the engagement length X of the interface between the latch holder 12 and end 14. The length X determines the distance the armature must travel before the interference between the end 14 and the latch holder 12 ceases causing the contacts 48 to open. Additionally, it is advantageous to accurately maintain the predetermined length X for all circuit breakers of a given model and rating. Accurately maintaining the length X provides better consistency for purposes of calibration.

Referring to line A—A in FIG. 1, an air gap distance is defined along line A—A between the top of the magnetic yoke 18 and the bottom of the armature 10. This distance affects the time it takes for armature 10 to be urged downward when there is a fault current in the circuit breaker.

Accordingly, it would be useful to provide a simple and inexpensive means for providing a consistent distance X and/or reducing the air gap distance. Additionally, it would advantageous to provide a means for performing this task without requiring extensive modification of the circuit breaker housing and the circuit breaker components, since these modifications would most likely render certain existing tooling and manufacturing processes useless.

SUMMARY OF THE INVENTION

An object of the present invention is to provide a simple and inexpensive means for providing consistent engagement lengths and reduced air gap distances in magnetically activated circuit breakers.

Accordingly there is provided an armature for a circuit breaker. The circuit breaker is of the type which includes a pair of contacts, a contact control mechanism and a thermally actuated member. The armature comprises: means for cooperating with a pivot member within the circuit breaker for pivotally mounting the armature within the circuit breaker; means for biasing the armature; engagement means adapted to engage the contact control mechanism for maintaining the contacts in a closed position; means engagable with the thermally actuated member such that the engagement between the engagement means and control mechanism ceases when the temperature of the thermally actuated member reaches a predetermined level; and means for providing the armature with a predetermined pivot angle within the circuit breaker.

An advantage of the present invention is that it provides a means for providing consistent engagement lengths and reduced air gap distances in magnetically activated circuit breakers without substantially modifying existing circuit breaker configurations.

Various other objects and advantages of the present invention will become apparent from the following description, with reference to the accompanying drawing.

DETAILED DESCRIPTION OF THE PREFERRED EMBODIMENT

Figure 1:
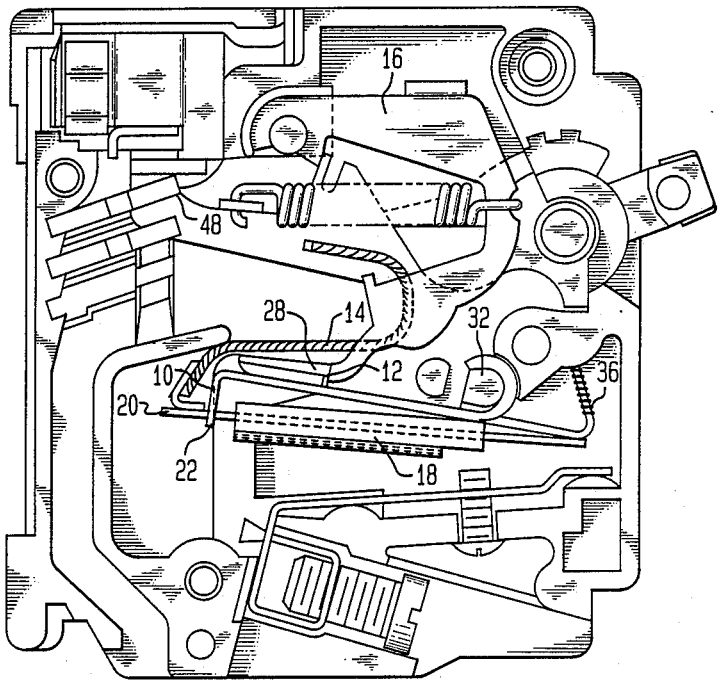
FIG. 1 (PRIOR ART)
FIG. 1 is a side view of a circuit breaker with its side cover removed.
Figure 2:
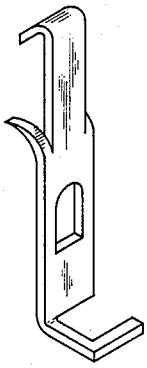
FIG. 2 (PRIOR ART)
FIG. 2 is a view of a prior art magnetic armature.
Figure 3:
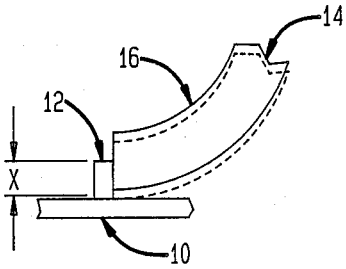
FIG. 3 is an enlarged view of a cradle to armature engagement.
Figure 4A:
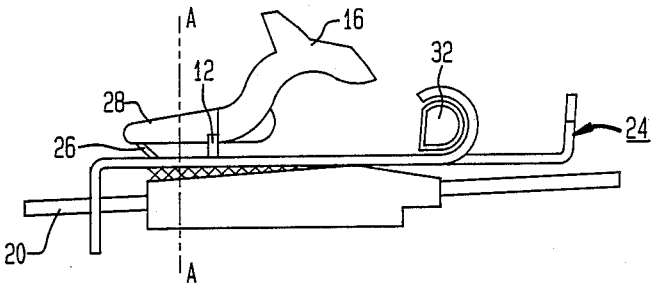
FIGS. 4*a* and 4*b* are side views of cradle to armature engagement illustrating in part relative air gap distances.

Referring now to FIG. 4*a*, FIG. 4*a* illustrates a side view of the preferred embodiment of the magnetic armature 24. This armature 24 is adapted to replace the armature 10 illustrated in FIG. 1. FIG. 4*a* illustrates the manner in which the armature 24 cooperates with the components of the circuit breaker. The main feature of the armature 24 is the means for providing a consistent engagement length and reduced air gap distance, which in the preferred embodiment takes the form of a control leg 26.

Figure 4B:
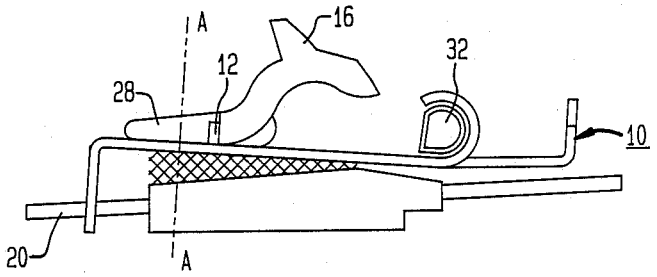
Figure 5:
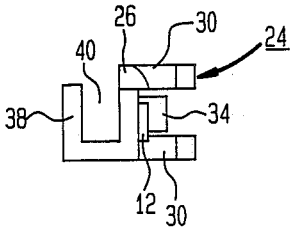
FIG. 5 is an end view of the preferred embodiment of the magnetic armature.
Figure 6:
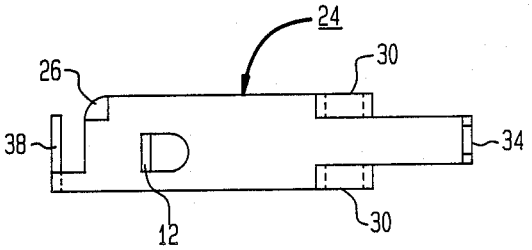
FIG. 6 is a top view of the preferred embodiment of the magnetic armature.
Figure 7:
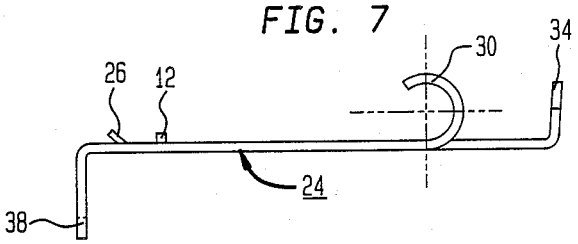
FIG. 7 is a side view of the preferred embodiment of the magnetic armature.

The control leg 26 is more clearly illustrated in FIGS. 5–7. From the figures it can be seen that the control leg 26 is simple to manufacture since it if formed by bending up a the corner portion of the armature 24. Depending on the desired characteristics of a circuit breaker, the size of the control leg 26 can be varied. By comparing FIGS. 4*a* and 4*b*, the effect of the control leg 26 can be appreciated. When the armature of FIG. 4*b* is replaced with the armature 24 the air gap distance along line A—A is reduced and the engagement length between the cradle end 14 and latch holder 12 is reduced. These reductions are provided for since the control leg 26 spaces the armature 24 downward from the armature stop 28. The engagement length can be accurately reproduced from circuit breaker to circuit breaker since the size of the control leg 26 can be accurately controlled.

Referring again to FIGS. 5–7, the armature 24 is shown as also including two members 30 for allowing the armature to pivot about the pivot member 32. The armature 24 also includes a member 34 upon which a biasing spring 36 is mounted. The armature 24 also includes a hooking member 38 which functions to allow the bimetalllic strip to move freely within the opening 40 while the circuit breaker is operating within its rated limits. The opening 4 is sized depending on the current carrying capacity of the circuit breaker. For example, if the rating of the circuit breaker is increased the size of the opening is increased so that the bimetallic strip can move further downward before urging the armature 24 downward.

While one embodiment of a magnetic armature for a circuit breaker has been shown and described in detail herein, various other changes and modifications may be made without departing from the scope of the present invention. For example, the housing could be adapted to include a control leg for providing a consistent engagement length and reduced air gap distance.

We claim:

1. An armature for a circuit breaker, the circuit braker having a pair of contacts, an armature stop means, a contact control mechanism and a thermally actuated member, the armature comprising:

an armature body including a first end and a second end;

means for pivotally mounting the armature within the circuit breaker, the means cooperating with a pivot member within the circuit breaker, the means being between the first end and the second end;

means for biasing the armature;

a projection for engaging the contact control mechanism for a predetermined engagement length such that the contacts are maintained in a closed position;

means engagable with the thermally actuated member such that the engagement between the engagement means and the control mechanism ceases when the temperature of the thermally actuated member reaches a predetermined level; and a control leg engageable with the armature stop means such that the armature is provided with a predetermined pivot angle within the circuit breaker, wherein the predetermined engagement length is determined by the pivot angle the control leg projecting from the armature body between the first end and the means for pivotally mounting.

2. The armature of claim 1 wherein the means for biasing the armature comprises a spring and a spring member upon which the spring is mounted.

3. The armature of claim 2 wherein the means engagable with the thermally actuated member comprises an end hook extension including a leg for engaging the thermally actuated member.

4. A magnetically actuated circuit breaker comprising:

a pair of contacts; an armature stop means;

a pivot member;

a contact control mechanism;

a heat actuated member; and an armature comprising:

an armature body including a first end and a second end;

means for pivotally mounting the armature within the circuit breaker, the means cooperating with a pivot member within the circuit, breaker, the means being between the first end and the second end;

means for biasing the armature;

a projection for engaging the contact control mechanism for a predetermined engagement length such that the contacts are maintained in a closed position;

means engagable with the thermally actuated member such that the engagement between the engagement means and the control mechanism ceases when the temperature of the thermally actuated member reaches a predetermined a predetermined level; and a control leg engageable with the armature stop means such that the armature is provided with a predetermined pivot angle within the circuit breaker, wherein the predetermined engagement length is determined by the pivot angle, the control leg projecting from the armature body between the first end and the means for pivotally mounting.

5. The armature of claim 4 wherein the means for biasing the armature comprises a spring and a spring member upon which the spring is mounted.

6. The armature of claim 5 wherein the means engageable with the thermally actuated member comprises an end hook extension including a leg for engaging the thermally actuated member.

* * * * *